United States Patent [19]

Duerr

[11] Patent Number: 4,700,759

[45] Date of Patent: Oct. 20, 1987

[54] WOOD SPLITTER

[76] Inventor: Dennis Duerr, Rte. 1, Box 144, E. 12122 Day Mount Spokane Rd., Mead, Wash. 99021

[21] Appl. No.: 847,203

[22] Filed: Apr. 2, 1986

[51] Int. Cl.[4] ..... B27L 7/00

[52] U.S. Cl. ..... 144/193 A; 83/111; 83/130; 83/142; 144/193 R

[58] Field of Search ..... 144/193 R, 193 A, 366, 144/3 K, 193 F; 83/111, 129, 130, 142

[56] References Cited

U.S. PATENT DOCUMENTS

| | | | |
|---|---|---|---|
| 2,851,072 | 9/1958 | Gerjets et al. | 144/193 A |
| 3,779,295 | 12/1973 | Balsbaugh | 144/193 A |
| 4,275,779 | 6/1981 | Rowe | 144/193 R |
| 4,444,231 | 4/1984 | Dillon | 144/193 A |

*Primary Examiner*—W. D. Bray
*Attorney, Agent, or Firm*—Wells, St. John & Roberts

[57] ABSTRACT

A blade type wood splitter is described including a blade guarding housing that is movable along with the blade to engage a wood block prior to contact of the block by the cutting edge of the blade. The housing rests against the wood block as the blade is driven through and later is retracted with the blade following the splitting operation. The housing includes a peripheral wood engaging edge that substantially circumscribes the cutting edge of the blade and is normally spaced therefrom toward the platform on which the wood blocks are received. This edge may first engage the wood block as the blade is moved toward splitting contact with the block. The edge may therefore provide ample warning to an operator who has inadvertently placed fingers in the path of the blade by contacting the fingers before the blade descends to cause injury. The housing also functions as a stripping device for allowing withdrawal of the blade from between binding pieces of wood by holding the wood stationary as the blade is retracted. The housing also includes outwardly flared walls for engagement with adjacent wood surfaces to hold the wood in position and to resist outward "kick out" of the split sections.

21 Claims, 5 Drawing Figures

WOOD SPLITTER

FIELD OF THE INVENTION

The present invention relates to wood splitting apparatus and more particularly to such apparatus using a wood splitting blade.

BACKGROUND OF THE INVENTION

Continued popularity of wood as a source of heat has lead to increasing use of powered apparatus for wood splitting purposes. Many different forms of mechanical wood splitters have been developed. The most common design involves a frame mounted blade and platform arrangement wherein the blade, platform or both are driven toward and away from one another usually by a hydraulic cylinder. A wood block is placed between the blade and platform and the cylinder is activated to move the platform and blade together relative to one another thereby driving the blade through the wood block.

Loading of such wood splitters typically involves manually placing each wood block on the splitter framework between the blade and platform, then holding the wood in place as the driving mechanism is actuated. There is an inherent danger that injury can occur as the wood and blade come together. A need has therefore developed for increasing safety in use of such apparatus, particularly in the area of the blade.

The present invention represents a solution to the problem of providing an efficient yet safe wood splitter.

BRIEF DESCRIPTION OF THE DRAWINGS

A preferred form of the present invention is illustrated in the accompanying drawings in which.

DETAILED DESCRIPTION OF THE PREFERRED EMBODIMENT

Figure 1:
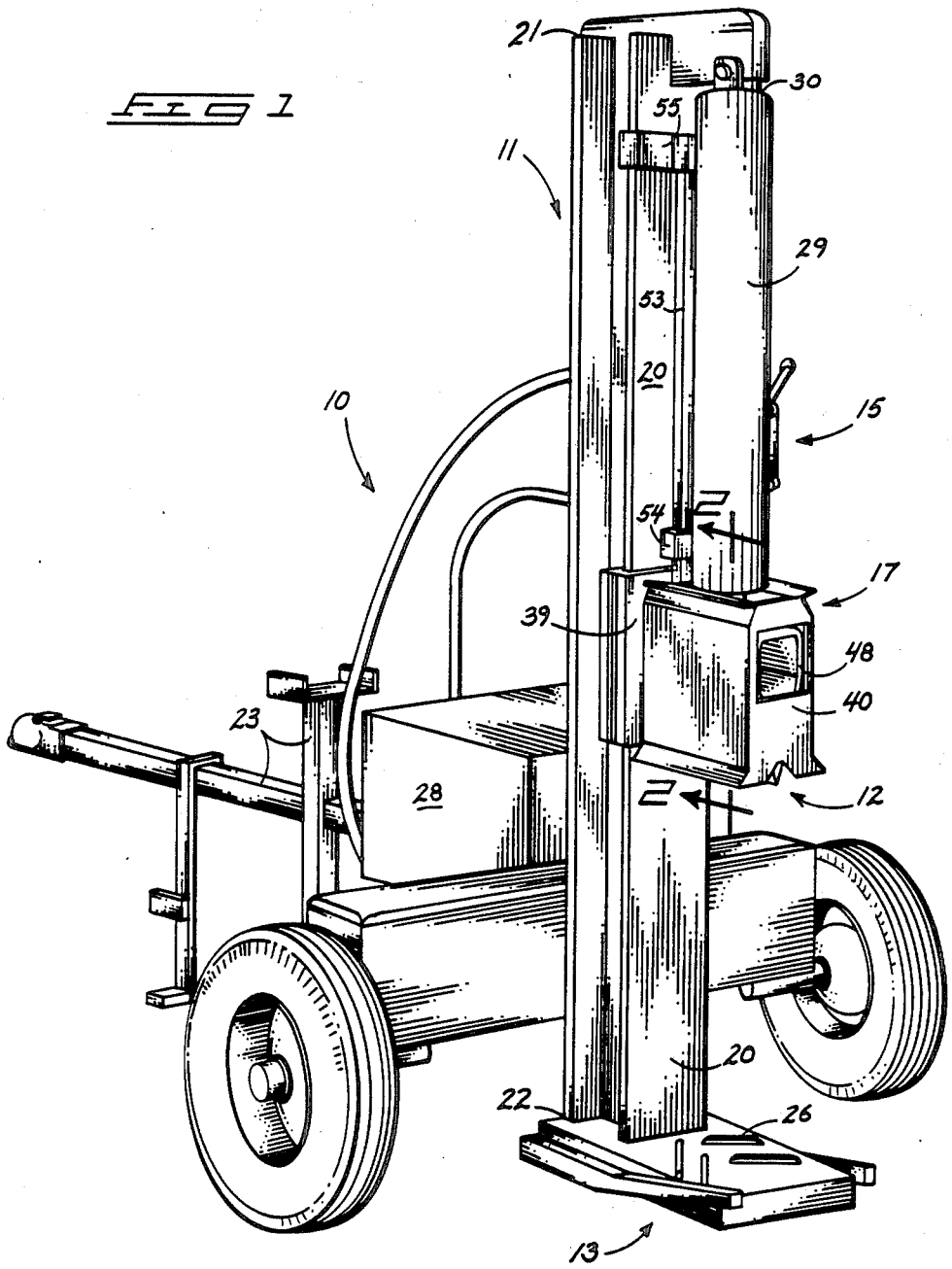
FIG. 1 is a pictorial view of the present splitter.

In compliance with the constitutional purpose of the Patent Laws "to promote the progress of science and useful arts" (Article 1, Section 8), applicant submits the following disclosure of the invention.

The present invention is exemplified by the wood splitter generally designated in the accompanying drawings by the reference numeral 10. The wood splitter 10 is basically comprised of a relatively rigid and elongated frame 11. A wood splitting blade member 12 movably mounted to the frame relative to a platform member 13. The blade member 12 and platform member 13 shown in the present drawings are arranged on the splitter 10 such that the blade is movable toward and away from the platform. The platform is affixed to the frame and is stationary relative to the blade. However, it should be understood that the arrangement could be made such that the blade and platform could both be movably supported on the frame for movement toward and away from one another. However, the arrangement shown is preferable for simplicity in manufacture and to minimize cost and maintenance.

A drive means 15 is provided on the frame 11 for selective operation to drive one of the members 12, 13 toward the other. As shown, and briefly discussed above, it is preferred that the blade be movable relative to the platform. Therefore, the drive means 15 is shown mounting the blade to the frame for movement toward and away from the platform.

An important aspect of the present invention 13 embodied in a housing means 17 for enclosing the blade 12 while it is moved toward and away from the platform. The housing means is operatively mounted to the framework for movement with the blade until it engages a wood block previously positioned against the platform. At this time, the housing will rest against the wood block while the blade is forced on through the block toward the platform. The housing is arranged on the splitter for sliding movement relative to the blade such that independent motion of the blade and housing can be achieved.

A stripping eans 18 is provided between the housing and frame 11 for selectively stripping a block of wood from the blade as the drive means is operated to retract the blade.

The above paragraphs set forth a general description of the present invention. The following paragraphs will describe the invention and the interrelationship of important aspects thereof in greater detail.

The frame generally indicated above may be comprised of an elongated rigid I-beam 20 extending between a top end 21 and a bottom end 22. The I-beam 20 may be movably supported by a wheeled carriage 23 having appropriate fixtures thereon for attachment to a towing vehicle. The I-beam 20 may be hinged to the carriage for selective pivoted movement between a horizontal position (not shown) and an upright configuration as shown in the drawings. The present splitter may be operated in either the horizontal or vertical orientations.

The platform 13, as briefly indicated above, may be rigidly affixed to the frame, it is preferably welded to the I-beam 20 at the bottom end 22. It is also preferable that the platform 13 be provided with raised ribs or surfaces 26 for contact with wood blocks received thereon. The ribs or raised surfaces 26 aid in holding each wood block in position on the splitter during the splitting operation. The ribs or raised surfaces 26 prevent "kick out" which could otherwise occur when splitting wood that is crooked or has not been cut perfectly "square" (with parallel ends substantially perpendicular to the long axis of the block).

The drive means 15 may include an engine 28 (schematically shown in FIG. 1) connected by conventional hydraulic pump and valving mechanisms to a double acting cylinder 29. The cylinder 29 is preferably a double acting (extendable and retractable) hydraulic ram cylinder and is mounted at an upper end 30 to the frame 11. The length of the cylidner 29 between end 30 and its bottom end 31 is determined by the stroke requirement for the blade 12 which is mounted to the piston shaft 32 of the cylinder.

The blade 12 includes a tapered wedge configuration leading from a top end or shoulder 36 to a cutting edge 37 facing the platform 13. The cutting edge 37 is preferably substantially perpendicular to the axis of the cylinder shaft 32 and is sharpened for ease in splitting wood blocks along the grain thereof.

The blade 12 may also be slidably mounted to the framework by means of a slide 39. The slide 39 is carried along an outward flange of the I-beam 20 and rigidly secures the blade 12 for sliding motion along the beam length. The slide secures the blade against motion other than pure translational motion along the length of the I-beam. The slide therefore protects the piston shaft and cylinder against lateral forces that could otherwise be transmitted through the blade by engagement with wood blocks having crooked or irregular grain.

The housing means 17 is comprised of a rigid enclosure 40 that is slidably mounted to the blade and shaft for releasably enclosing the blade edge as the blade is moved between the retracted position and a position engaging the wood block.

The housing includes an open top end 41 that is movably or slidably received over the cylinder shaft 32. A cross member 42 extends across the open housing to be releasably received against the top shoulder end 36 of the blade 12. The housing may rest with the cross member 42 engaged against the top surface shoulder of the blade by force of gravity or by an appropriate yieldable biasing means (not shown).

The rigid housing 17 also includes side walls 43 that extend from the top end 41 to a bottom wood engaging edge 46. The edge 46 substantially circumscribes the blade edge 37 and is spaced outwardly therefrom by flared walls 45. The distance from the top end or the point at which the cross member 42 rests against the top blade end 36 and the bottom edge 46 is somewhat greater than the dimension of the blade between cutting edge 37 and the top shoulder 36. The housing will therefore normally encase the blade as shown in FIG. 2, with the bottom wood engaging edge 46 extending about and spaced from the sharp blade edge.

The edge 37 of the blade may be viewed by visual inspection means 47 provided on the housing. Inspection means 47 may be comprised of a window 48 formed through one of the sides 43 or an inverted, V-shaped notch 49 formed along the peripheral edge 46. The widow or notch may be utilized to visually indicate the position of the blade edge and to enable removal of debris that may accumulate between the blade and housing during the splitting operations.

Figure 2:
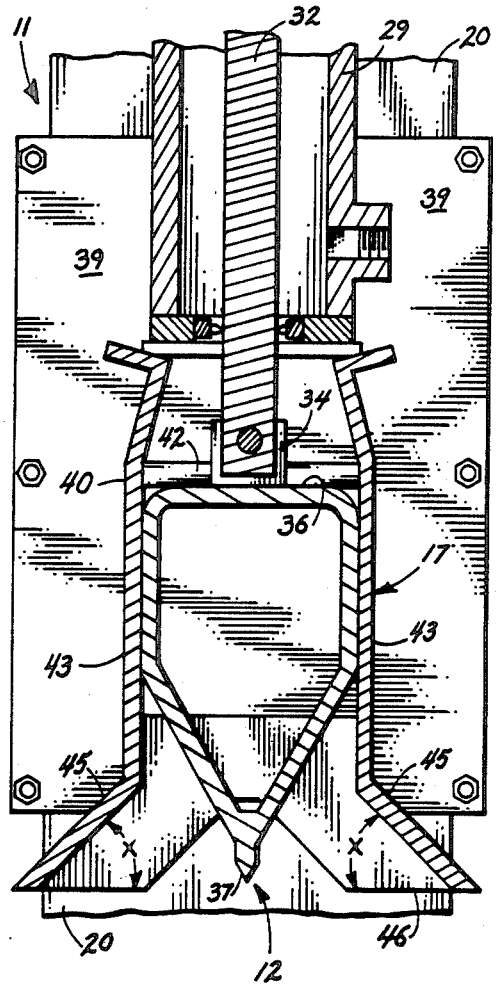
FIG. 2 is an enlarged fragmented sectional view taken substantially along line 2—2 of FIG. 1.
Figure 3:
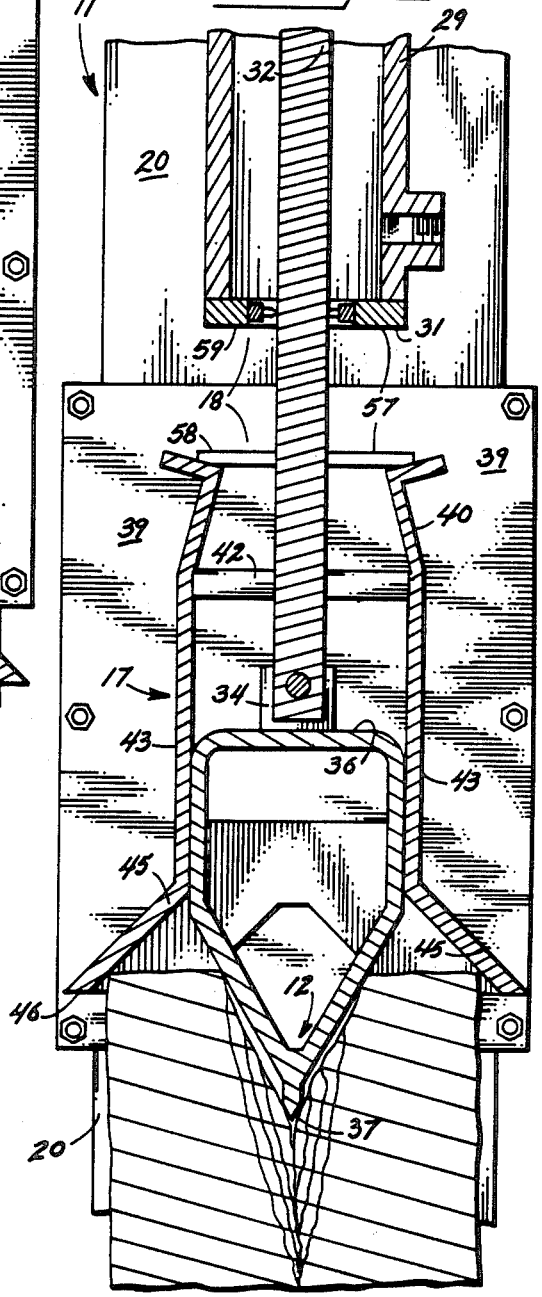
FIG. 3 is a view similar to FIG. 2 only showing the blade in a down position and in relation to a wood block.
Figure 4:
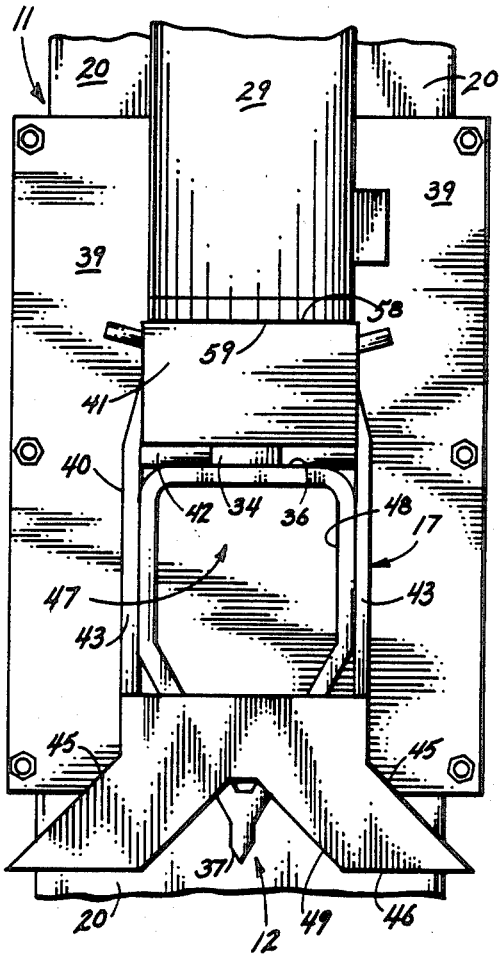
FIG. 4 is a frontal view of the elements sectioned in FIG. 2.
Figure 5:
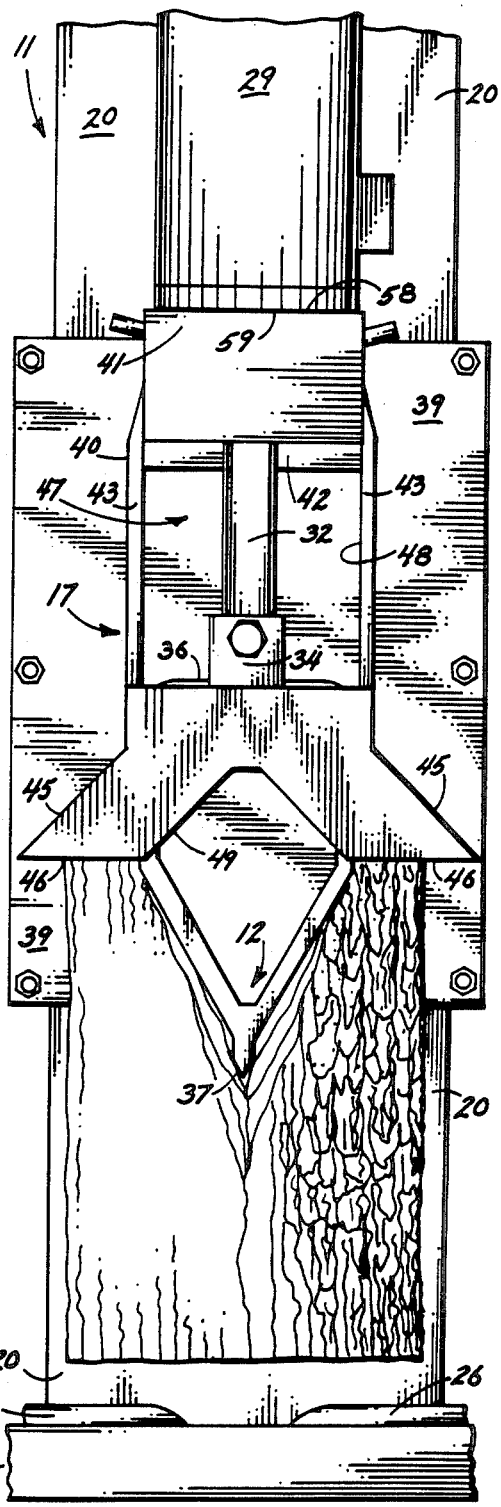
FIG. 5 is a frontal view similar to FIG. 4 only showing the operation of wood stripping means provided in the present invention.

The flared walls 45 as shown in FIGS. 2–5 have the dual function of spacing the wood engaging edges 46 outwardly of the blade edge and for substantially centering and holding wood blocks in position prior to engagement thereof with the splitting blade 12. The inclined surfaces are formed preferably along equal acute angles to the horizontal as indicated in FIG. 2 by the angles indicated at "X". These angles are equal so the inclined surfaces will perform a "centering" function, tending to engage and hold or cam the ends of small blocks of wood into a centered position in relation to the blade edge 37 as the blade moves toward the block. These surfaces also act to avoid "kick out" at the end of the block engaged thereby by yieldably holding split wood halves together as the blade is driven through. The weight of the housing will act with the inclined surfaces to hold the split sections of the block together. The downwardly moving blade, however, forces the split sections apart. This action causes the split sections to move apart and cam against the inclined surfaces of the housing walls 45. The camming action lifts the housing (since the housing is allowed to rest only by its weight against the end of the wood block). However, separation of the splitting sections is yieldably resisted by the housing which, by its weight and the inclined surfaces 45, tend to hold the split pieces together. The housing will therefore gradually yield to the downward pressure of the blade, which forces the wood pieces apart so the halves of the wood are allowed to separate. The housing simply functions to resist the tendency for the split sections of the block to fly apart.

The housing 17 may be slidably mounted to the frame by an elongated guide bar 53. The guide bar is affixed at the top end of the housing 17 and extends therefrom parallel to the I-beam 20. It is slidably mounted to the I-beam by a guide bar bracket 54. The bracket 54 and a slide 55 secured to the top end of the bar guide sliding motion of the housing along the frame in response to motion of the blade 12. The bar 53, bracket 54 and slide 55 are also provided to hold the housing in position relative to the blade during the splitting operation.

The stripping means 18 may broadly be considered as a stop means operatively mounted between the hollow housing and frame for limiting motion of the housing away from the platform. This means may be comprised of a first abutment 58 situated on the housing 17 and a second abutment 59 operatively connected to the frame. Such "operative" connection may be made through the cylinder 29 and the abutment surface 59 may be situated at the bottom end 31 thereof.

The two abutment surfaces 58 and 59 are aligned with one another along the frame and will contact as the cylinder is retracted, bringing the blade to its fully retracted position. The housing is held stationary by the engaged abutments as the blade is retracted. The bottom wood engaging edge of the housing will hold the wood stationary so the blade can be pulled outwardly therefrom. This action shown graphically in FIG. 5.

The stripping action is needed only after the blade has been fully extended and, for some reason, the wood has not split completely into halves. The wood will typically bind against the blade so the wood block will be lifted by the blade upon retraction of the cylinder. The block will lift the housing 17 as the blade is retracted until such time that the abutment surfaces 58 and 59 come into contact. The engaged surfaces then hold the housing and wood block stationary as the cylinder continues to retract. The blade can thereby be pulled from between the binding surfaces of the block until the blade edge becomes disengaged from the block. The wood is therefore stripped from the blade against the stationary housing held by its abutment with the relatively stationary cylinder end 31. The dimension of the housing as described above may be such that the blade can be retracted fully from the wood block with the cutting edge 37 retracting above the wood engaging surfaces or edge 46. Complete release from the wood block is therefore assured.

From the above technical description, operation of the present invention may be easily understood.

The splitting operation involved with the present invention may begin as a wood block is placed on the platform 13, preferably in such a position that the grain extends substantially parallel to the length of the I-beam 20. The block may be held in place by hand as an appropriate valve is actuated to extend the cylinder 29. As this is done, the blade and housing both move toward the platform.

The bottom wood engaging edge 46 of the housing precedes the cutting edge of the blade as it is moved toward the block. The edge 46 will contact any inappropriately placed fingers and therefore provide ample warning to the operator that his or her hand is placed dangerously close to the approaching blade. If this occurs, the operator will immediately realize the dangerous situation from contact with the housing edge. The misplaced finger or hand can then be withdrawn before the blade makes contact. Alternatively, the operator can operate the cylinder to retract and the housing will be lifted by the blade from engagement with the endangered body part. The weight of the housing bearing against the finger or hand is insufficient to cause significant injury. However, since the weight of the housing is borne by the engaged tissues, it is unlikely that the potentially hazardous situation will go ingored.

Assuming the wood block has been properly held with fingers and hands adequately clear of the approaching blade, the blade will descend carrying the bottom wood engaging edge 46 of the housing into contact with the upper surface of the block. The wood block will then bear the weight of the housing, holding it against further downward movement. The blade, however, will continue to descend and the edge 37 will be moved into engagement with the block end. Continued extension of the cylinder will force the blade on through the block toward the platform. The housing will remain engaged at the top end of the block as the blade descends to split the block into two or more sections.

As the splitting action occurs, the outwardly flared walls of the housing act against the engaged surfaces of the split sections to yieldably hold the sections together and prevent kick out. The raised surfaces of the platform perform the same function at the opposite end of the block to prevent dangerous kick out of the wood sections as the splitting action occurs.

As the splitting operation is completed, the split sections of the block are forced away from one another by the wedge shape of the blade. These outwardly moving splitting sections of wood slide over the flared walls of the housing, lifting the housing upwardly until the split sections separate completely and fall free to opposite sides of the platform. At this time, the housing may slide on downwardly (guided by the guide bar 53, the bracket 54 and slide 55) over the blade to again partially encase the blade and become supported thereon due to engagement between the cross bar 42 and the top shoulder end 36 of the blade. The housing will thus ride on the blade as it is retracted by the cylinder for the next successive splitting operation.

Situations typically occur in which the splitting operation may not be completed by a single stroke of the blade. Twisted grain or other inconsistencies in wood blocks may lead the blade to become "stuck" in the block at the bottom of the stroke. When this occurs the wood will be lifted along with the blde as the cylinder is retracted. The stripping means is provided to strip the wood from the retracting blade. It operates as the housing is lifted by the wood block and the abutment surfaces 58 and 59 come into contact with one another. The engaged abutment surface will hold the housing stationary relative to the frame as the blade continues to retract. The housing therefore holds the wood against further upward movement and the blade can be pulled free of the binding wood sections. Complete withdrawal is assured since the blade can be pulled to a completely retracted position spaced clear of the housing wood engaging edge 46 and the engaged surface of the wood block.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifcations within the proper scope of the appended claims, appropriately interpreted in accordance with the doctrine of equivalents.

I claim:

1. A wood splitter for splitting wood blocks, comprising:

a frame;

a platform member on the frame for engaging a wood block at one end thereof;

a splitting blade member on the frame having a blade edge for engaging a wood block at an end thereof opposite the one end;

drive means for moving one of the members toward the other to split a wood block and for moving the one member away from the other to leave a block receiving space therebetween;

a hollow housing means for receiving and releasably encasing the splitting blade member during movement thereof relative to the platform toward and away from engagement with a wood block; and stripping means on the housing means operatively communicating with the frame for stripping the wood block from the blade member as the one member is moved away from the other.

2. The wood splitter of claim 1 wherein the platform is fixed on the frame and the drive means is connected between the blade member and frame for moving the blade member toward and away from the platform member and wherein the hollow housing means is mounted to the blade member for movement therewith and is yieldably biased toward the platform member.

3. The wood splitter of claim 2 further comprising guide means mounting the hollow housing means to the frame for sliding movement thereon responsive to movement of the blade member.

4. The wood splitter of claim 2 wherein the stripping means is comprised of:

stop means operatively mounted between the hollow housing means and frame for limiting motion of the housing means away from the platform member; and wherein the housing means includes a block engaging edge for engaging and holding a wood block stationary relative to the frame as the blade member is moved away from the platformmember.

5. The wood splitter of claim 4 wherein the stop means is comprised of:

an abutment on the housing means and a complimentary abutment operatively mounted to the frame;

said abutments being aligned along the frame for contact with one another as the blade member and housing means are moved away from the platform member.

6. The wood splitter of claim 1 wherein the drive means is comprised of a hydrualic cylinder having a cylinder body attached to the frame and a piston shaft attached to the blade member, said cylinder being selectively powered to extend and retract said piston shaft; and wherein the hollow housing means is slidably mounted over the piston shaft and is loosely received over the blade member for movement with the blade member; and wherein the hollow housing means includes a wood engaging edge surface normally spaced toward the platform member from the blade edge and movable responsive to blade movement to contact a wood block on said platform member and to rest against the engaged wood block as the blade member continues to move on toward the platform member.

7. The wood splitter of claim 6 wherein the wood engaging edge surface is integral with the hollow housing means and substantially encompasses the blade edge.

8. The wood splitter of claim 6 further comprising:

a guide bar mounted to the hollow housing means and extending longitudinally along the frame; and a guide bar bracket mounting the guide bar to the frame for free translational motion thereof responsive to motion of the blade member.

9. The wood splitter of claim 8 wherein said stripping means is comprised of an abutment on the housing means and a stationary abutment on the cylinder aligned along the path of the cylinder piston shaft and blade member such that said housing abutment is moved into contact with the stationary cylinder abutment as the piston shaft approaches a fully retracted condition, said cylinder abutment thereby then holding the housing means stationary as piston shaft continues to retract to a fully retracted condition.

10. The wood splitter of claim 1 further comprising an inspection window means formed through the hollow housing means for allowing visual access to the splitting blade member when encased by said housing means.

11. A wood splitter comprising:

an elongated rigid frame;

a platform on the frame for abutment against one end of a wood block;

cylinder means mounted to the frame and having a piston shaft oriented for extension toward and away from the platform;

a splitting blade means on the piston shaft and having a blade edge for movement therewith to engage a wood block at an end opposite said one end and for splitting the wood block against the platform;

a hollow housing movably carried on the splitting blade means normally enclosing the blade means and slidable along the piston shaft, said housing having an open end facing the platform;

wherein the open end of the housing is normally spaced toward the platform from the blade edge;

wherein the housing is yieldably biased toward the platform in relation to the blade means and slidable along the piston shaft so the open end of the housing will engage the wood block prior to engagement of the wood block by the blade means and so the housing will rest against the wood block as the blade means is driven through the wood block.

12. The wood splitter of claim 11, further comprising stripping means for holding the housing stationary against a wood block as the blade means is retracted.

13. The wood splitter of claim 12 wherein the stripping means is comprised of:

an abutment on the housing and a complimentary abutment operatively mounted to the frame;

said abutments being aligned along the frame for contact with one another as the blade means and housing are moved away from the platform.

14. The wood splitter of claim 11 further comprising:

a guide bar mounted to the hollow housing and extending longitudinally along the frame; and a guide bar bracket mounting the guide bar to the frame for free translational motion thereon responsive to motion of the blade means.

15. The wood splitter of claim 11 wherein the housing is flared outwardly at the open end thereof, away from the blade means.

16. The wood splitter of claim 11 further comprising visual inspection means on the housing for permitting visual access to the blade means through the housing when the blade means is received and enclosed within the housing.

17. A wood splitter, comprising:

an upright frame having top end and a bottom end a rigid platform at the bottom frame end for receiving and supporting a wood block;

a splitting blade having a top shoulder and a bottom cutting edge;

cylinder means on the frame and having an upright piston shaft mounting the splitting blade, said cylinder means being operable to extend the blade toward the platform to engage and split a wood block supported thereon and to retract to withdraw the blade away from the platform to a fully retracted position adjacent the cylinder;

a hollow housing slidably mounted over the piston;

a blade receiving recess formed within the housing and having a blade abutment surface adjacent a top end of the housing and an opening defined by a wood abutment edge substantially circumscribing the bottom cutting edge of the blade at a bottom end of the housing;

wherein the housing is normally received over the blade with the blade abutment surface resting gravitationally against the top shoulder of the blade and the wood abutment edge situated toward the platform from the bottom cutting edge of the blade such that said wood abutment edge will lead the blade downwardly as the cylinder is operated to extend and move the blade downward, such that said wood abutment edge will engage a wood block prior to engagement of the bottom cutting edge of the blade with the wood block and will rest against the wood block as the blade is driven on downwardly through the wood block toward the platform.

18. The wood splitter of claim 17 further comprising wood stripping means on the housing for stripping a wood block from the blade as the cylinder means is operated to retract the blade.

19. The wood splitter of claim 18 wherein the wood stripping means is comprised of a first abutment surface on the housing and a complimentary second abutment surface operatively connected to the frame and aligned with first abutment surface in relation to the path of movement of said blade, for engagement with the first abutment surface as the blade is retracted toward the fully retracted position.

20. The wood splitter of claim 17 wherein the housing includes outwardly flared walls leading to the wood abutment edge.

21. The wood splitter of claim 20 wherein the flared walls form equal acute angles to the horizontal.

* * * * *